United States Patent [19]

Matsutani

[11] 4,406,096

[45] Sep. 27, 1983

[54] ARTICULAR POLE ASSEMBLY CAPABLE OF WINDING

[76] Inventor: Keinosuke Matsutani, 14-7, Katori 2-Chome, Ichikawa-shi, Chiba, 272-01, Japan

[21] Appl. No.: 243,383

[22] Filed: Mar. 13, 1981

[30] Foreign Application Priority Data

Apr. 30, 1980 [JP] Japan ..... 55-56354

[51] Int. Cl.[3] ..... E04H 12/18

[52] U.S. Cl. ..... 52/108; 242/54 R

[58] Field of Search ..... 52/108; 49/325; 242/54 R, 54 A, 107, 84, 84.8

[56] References Cited

U.S. PATENT DOCUMENTS

| | | | |
|---|---|---|---|
| 1,413,642 | 4/1922 | White | 49/325 |
| 2,419,321 | 4/1947 | Lopes | 52/108 |
| 2,481,471 | 9/1949 | Crot | 52/108 |
| 2,832,590 | 4/1958 | Youngberg | 49/325 |
| 4,014,136 | 3/1977 | Hemens et al. | 49/325 |

OTHER PUBLICATIONS

The English Duden; A Pictorial Dictionary with Japanese Translation, published by Sanseido Co., Ltd. 1981, p. 458.

Dictionary of Mechanical Engineering, by J. L. Nayler and G. H. F. Nayler, 1977, p. 214.

*Primary Examiner*—J. Karl Bell

*Attorney, Agent, or Firm*—Armstrong, Nikaido, Marmelstein & Kubovcik

[57] ABSTRACT

There is disclosed a new articular pole assembly capable of winding, which comprises an articular pole and a take-up casing having a desired shape for the take-up of the pole in a wound or curved state, the articular pole being composed of a continuous series of unit block members connected to one another, the unit block members each having a pair of side plates and a connecting plate, the side plates being connected to the corresponding side plates of the adjacent unit block member by a pin, the connecting plate having bent projections releasably engaged with notches of the side plates of the adjacent block member with the proviso that a spring is employed to urge the projections of the connecting plate to push towards the notches of the side plates, the take-up casing having cam portions for disengaging the projections from the notches against the resilient action of the spring so as to make the unit block member rotatable about the pin, whereby the continuous series of the unit block members can be accommodated in a wound state in the take-up casing.

11 Claims, 20 Drawing Figures

ARTICULAR POLE ASSEMBLY CAPABLE OF WINDING

BACKGROUND OF THE INVENTION

The present invention relates to an articular pole or bar assembly capable of winding.

A telescopic slide mechanism is well known, which comprises two or more hollow tubes sliding one within another, providing a long support when extended. This mechanism is employed in tripods for optical machines, telescopic ladders, etc.

Long tongs are also known, which comprises zig-zag levers for picking up objects, the picking up grip being usually an action in a direction at right-angles to that of the applied power.

Such a telescopic slide device as well as lazy tongs has a drawback that the longer the distance of a point on the device from its base portion is, the lower the load-supporting capacity of this point is.

SUMMARY OF THE INVENTION

It is an object of the invention to provide an articular pole assembly which can be extended to a desired length when it is used, and which can be stored in a wound or bent state in a take-up casing. This pole assembly can be employed in a desk stand, an emergency bridge, ect.

It is another object of the invention to provide an articular pole assembly which can be easily extended, wound and transferred to a place where it is used or stored.

It is a further object to provide an articular pole assembly which brings about such a technical effect that, when it is extended, it provides a strong and rigid pole structure having a form of a straight line or an arch line inclined leftwards or rightwards.

It is still another object to provide an articular pole assembly which can be fabricated in a desired size and which can be employed in various industrial fields where an extendible pole is required.

It is still another object to provide an articular pole assembly which has rather a simple structure and which can be smoothly extended, wound and transferred.

In order to accomplish these objects, the invention contemplates providing a new articular pole assembly capable of winding, comprising an articular pole and a take-up casing for storing the pole, the articular pole being composed of a continuous series of unit block members connected to one another by connecting pins and by projection-notch engagements, with the proviso that, when the pole is pushed into the casing, the projection-notch engagement are released with disengaging means so as to make the pole rotatable about the connecting pins, whereby the continuous series of unit block members can be stored in a wound state in the casing.

More specifically, the invention relates to an articular pole assembly comprising:

an articular pole which is composed of a continuous series of unit block members connected to one other, the unit block members each having a pair of side plates and a connecting plate, the side plates being connected to the corresponding side plates of the adjacent unit block member by pins, the connecting plate having projections releasably engaged with notches of the side plates of the adjacent unit block member, with the proviso that a spring is employed to urge the projections of the connecting plate to push towards the notches of the side plates;

a take-up casing having a desired shape for the take-up of the articular pole in a wound or curved state, the take-up casing having cam portions for disengaging the projections from the notches against the resilient action of the spring so as to make the unit block member rotatable about the pins, whereby the pole can be kept in a wound state in the casing.

The foregoing and other characteristics of the invention will become clearer from the following description of preferred embodiments thereof given by way of examples and not in a limiting sense, and depicted in the annexed drawings.

DESCRIPTION OF THE PREFERRED EMBODIMENTS

Figure 1:
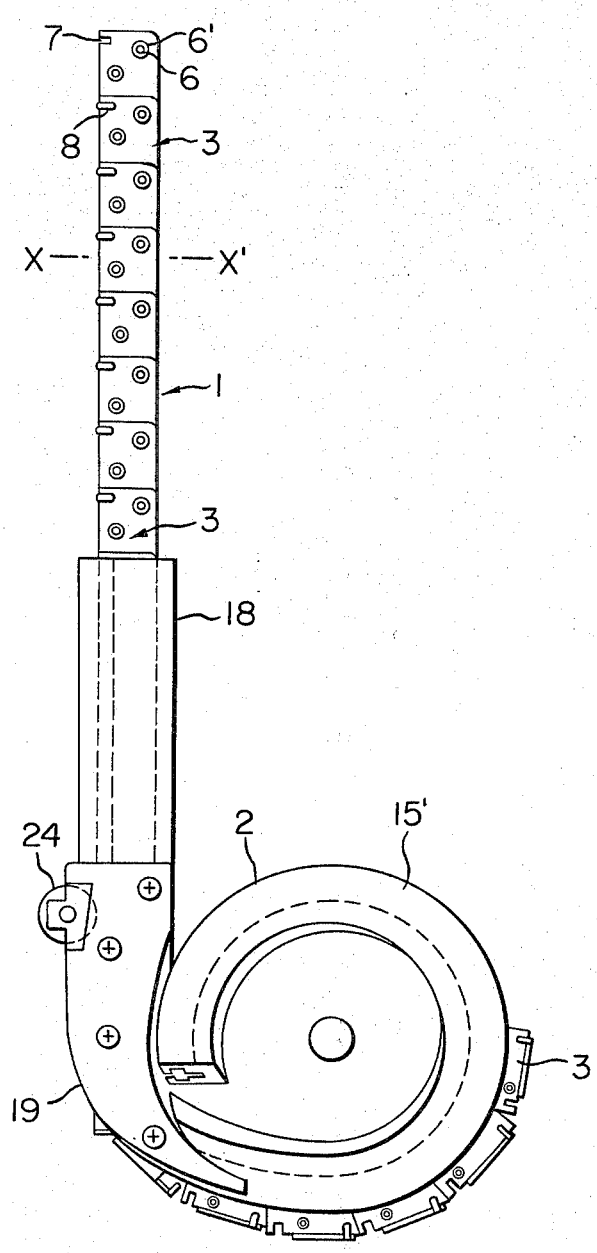
FIG. 1 is a front view of an articular pole assembly according to the invention.
Figure 2:
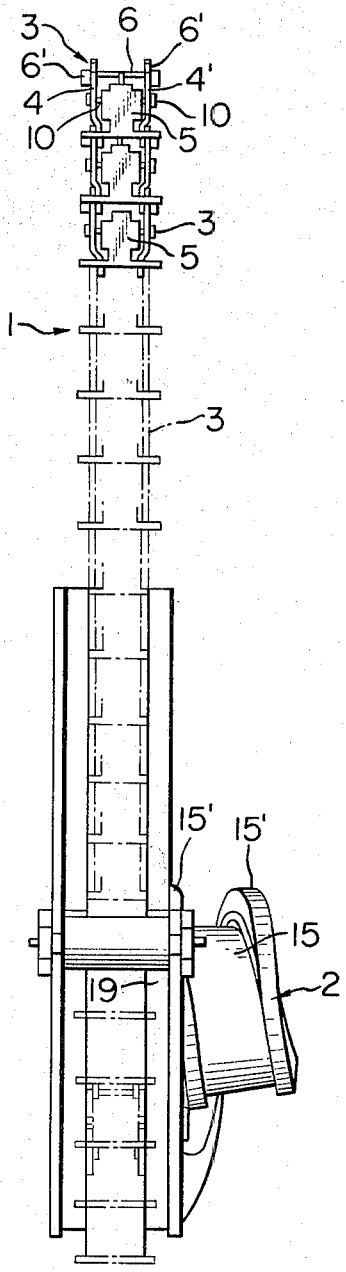
FIG. 2 is a right side view of the pole assembly shown in FIG. 1.
Figure 3:
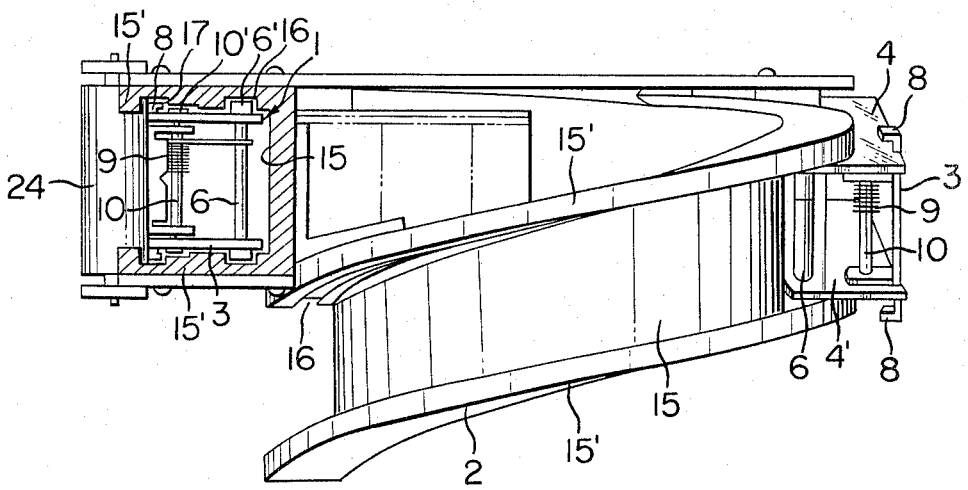
FIG. 3 is an enlarged cross-sectional view of the part taken along the line X—X' of FIG. 1.

In FIGS. 1 and 2, the reference numeral 1 denotes an articular pole capable of winding. The reference numberal 2 denotes a take-up casing having a spiral shape. However, the take-up casing may also have a different shape such as circle, vortex or the like, depending on the kind of things to be supported by the pole, and on the shape and the area of the space where the casing is placed.

Figure 4:
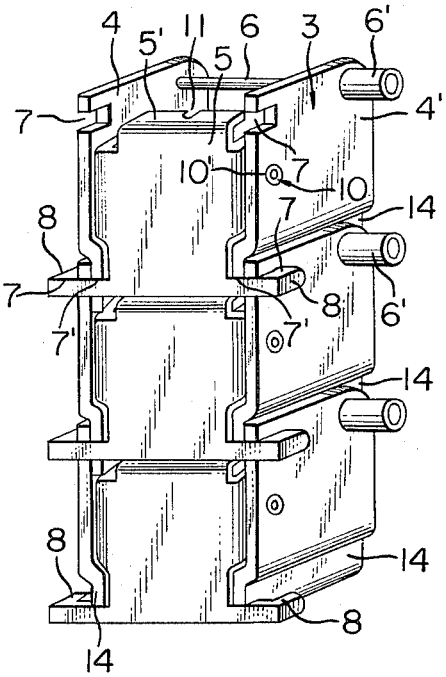
FIG. 4 is an enlarged partial perspective view of the pole assembly illustrated in FIG. 1.
Figure 5:
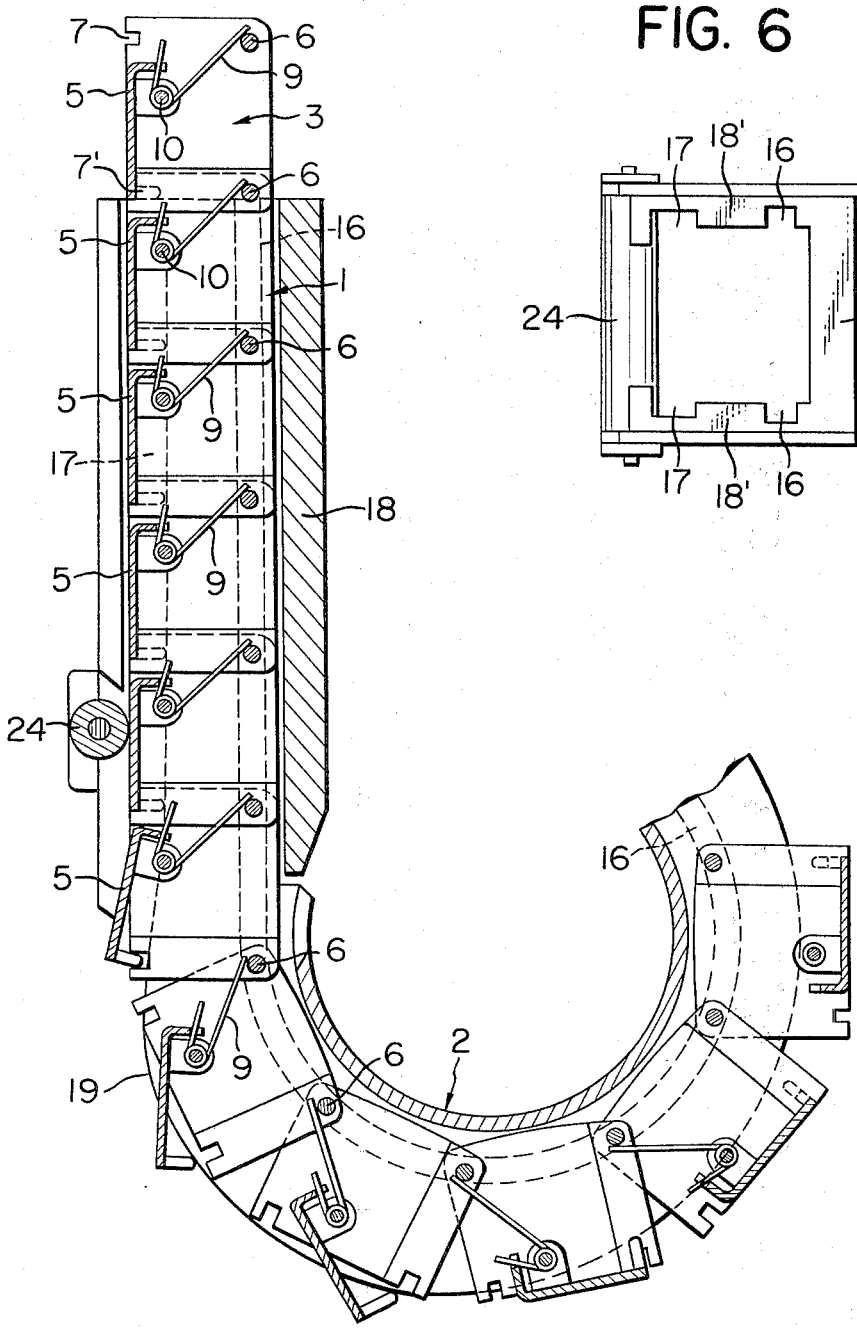
FIG. 5 is an enlarged partial longitudinal sectional view of the pole assembly of FIG. 1.
Figure 6:
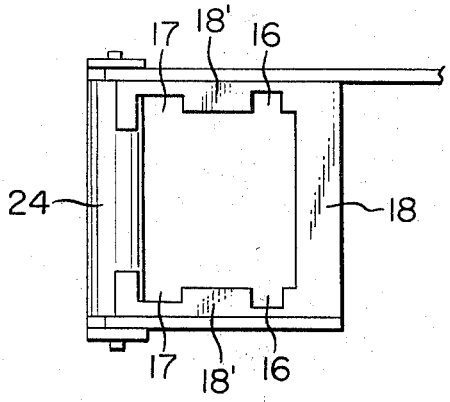
FIG. 6 is a plan view of the take-up casing sheath means of the pole assembly illustrated in FIG. 1.
Figure 8:
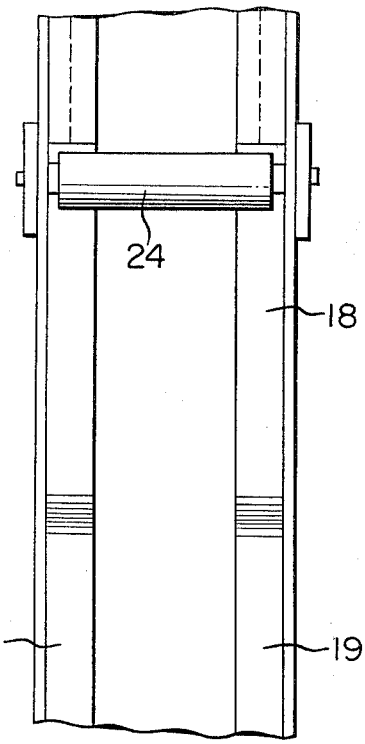
FIG. 8 is a partial front view of the casing illustrated in FIG. 6.
Figure 7:
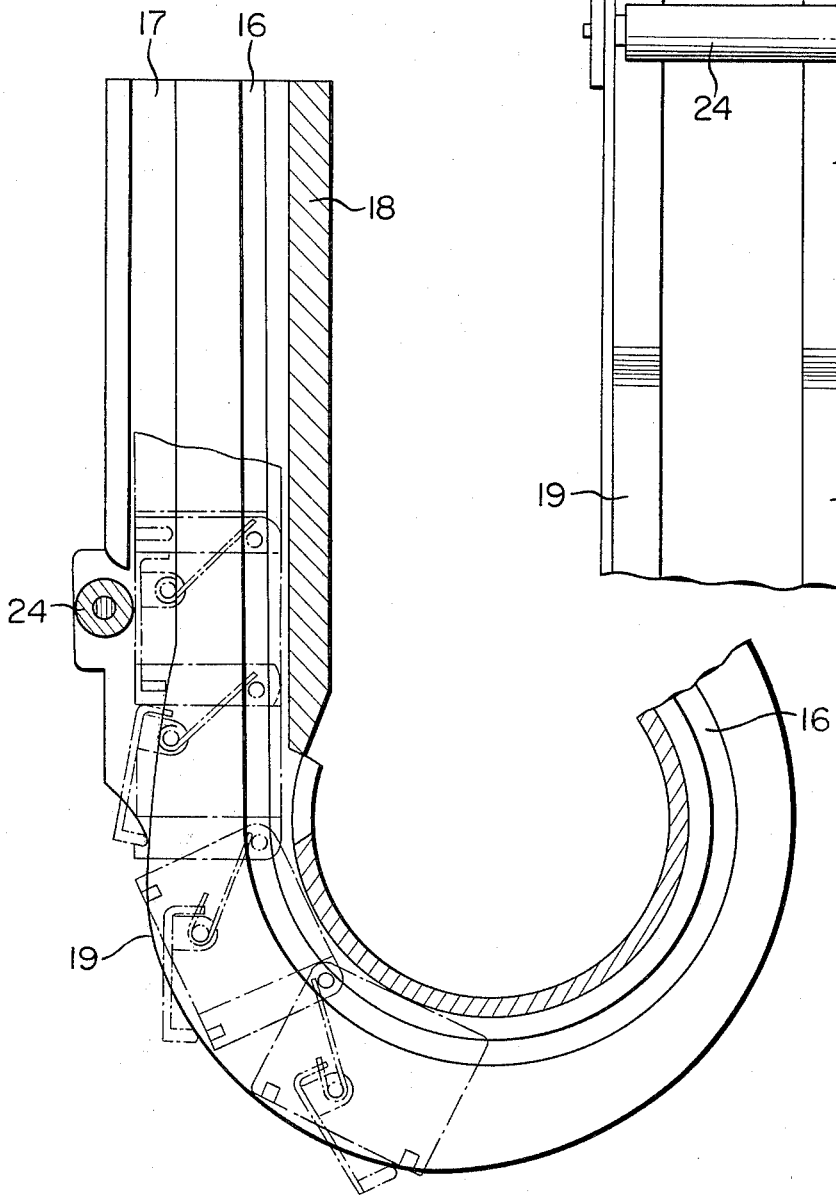
FIG. 7 is a cross-sectional view of the take-up casing illustrated in FIG. 6.

The articular pole 1 is formed by connecting a plurality of unit block members 3 to one another in series. As shown in FIG. 4, each unit block member 3 has a pair of side plates 4 and 4' facing each other. A connecting plate 5 is disposed in a space between the upper portions of the side plates 4 and 4' in a direction perpendicular to that of the side plates 4 and 4'. The connecting plate 5 is rotatably connected to the side plates 4 and 4' by a pin 10.

The unit block member 3 in question is rotatably connected to the adjacent block member by a pin 6 which is inserted into the side plates 4 and 4' in a direction perpendicular to that of these plates. The side plates 4 and 4' have notches 7 and 7', respectively, which are releasably engaged with the projections 8 and 8 of the connecting plate 5. A coil spring 9 is disposed on the pin 10 in such a manner that one end of the spring 9 is connected to the pin 6 and the other end is contacted with the notch 11, which has been formed on the upper bent portion 5' of the connecting plate 5. In order to connect the side plates 4 and 4' of the unit block member 3 to the corresponding side plates of the adjacent unit block member, the following operation can be conducted: stepped portions 14 are formed on the rear parts of the side plates 4 and 4', so that the stepped portions 14 of the side plates 4 and 4' of the former unit block member 3 can be laid inside the front parts of the side plates of the latter unit block member; and the resulting plate-superposition areas are connected together by means of the pin 6.

As shown in FIGS. 3 to 8, the spiral take-up casing 2 has an arched canal 15 for receiving and guiding the articular pole 1. The arched canal 15 has a rectangular cross-section with one open end like a U-shape cross-section. The right and left side walls 15' and 15' of the arched canal 15 are provided with grooves 16 and 16, respectively, for receiving the projected end portions of the pin 6. A straight or linear fore-casing 18 is connected to the spiral take-up casing 2. The side walls 18' and 18' of the fore-casing 18 are provided not only with grooves 16 and 16, respectively, for receiving the projected end portions 6' and 6' of the pin 6, but also with other grooves 17 and 17, respectively, for receiving the projected end portions 10' and 10' of the pin 10 and for receiving the bent projections 8 and 8 of the connecting plate 5 of the unit block member 3.

In the areas in and near the boundary between the spiral take-up casing 2 and the linear fore-casing 18, the marginal parts of the arched canal 15 are provided with curved cam portions 19 and 19, respectively, which have an action of disengaging the projections 8 and 8 of the unit block member 3 from the notches 7 and 7' of the adjacent block member against the resilient action of the spring 9 when these unit block members are passed through the cam portions 19 and 19 towards the take-up casing 2.

If the size of the articular pole 1 is relatively small, it can be moved by hand. If the size of the pole means 1 is large, it can be moved by a motor 20 via transmission means involving for instance, a sprocket 23 which can be engaged with the pins 6 of the pole 1.

When the articular pole 1, consisting of the continuous series of the unit block member 3, is moved towards the spiral take-up casing 2, and each block member 3 is passed through the curved cam portions 19 and 19, then the bent projections 8 and 8 of the connecting plate 5 of the unit block member 3 are ascended due to the action of the cam portions 19 and 19 so that the connecting plate 5 is moved round the pin 10, whereby the projections 8 and 8 of the unit block member are disengaged from the notches 7 and 7' of the adjacent unit block member, respectively. As a result of this disengagement, each block member 3 is made rotatable about the pin 6, so that the pole 1 has no longer a rigidity as a whole at this time, and can be accommodated in a wound or curved state in the spiral take-up casing 2.

When the articular pole 1, consisting of the continuous series of the unit block members 3, is pulled out from the spiral take-up casing 2, and each unit block member 3 is passed through the cam portions 19 and 19 towards the outside area, then the bent portions 8 and 8 of the unit block member 3 are pushed into and engaged with the notches 7 and 7' of the adjacent unit block member, respectively, under the resilient action of the spring 9, so that the articular pole 1 is made to have a rigidity as a whole. So, when the articular pole 1 has been pulled out from the casing 2, it has a rigidity as a whole.

Figure 9:
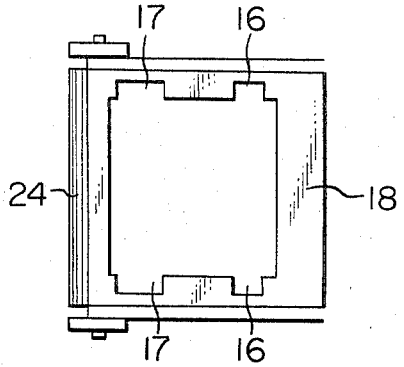
FIG. 9 is a plan view of another casing employed in accordance with the invention.
Figure 11:
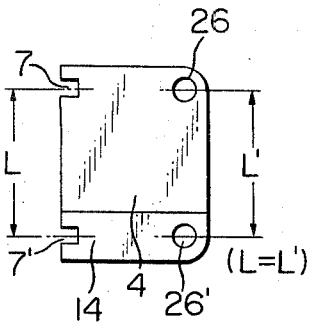
FIG. 11 is a side view of a unit block member employed in the invention.
Figure 10:
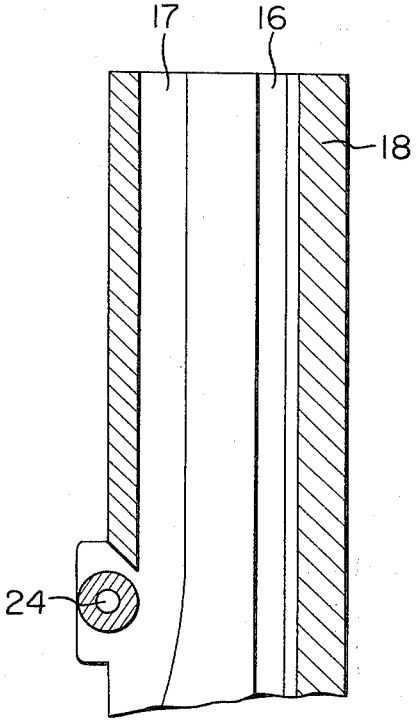
FIG. 10 is a longitudinal sectional view of the casing of FIG. 9.
Figure 12:
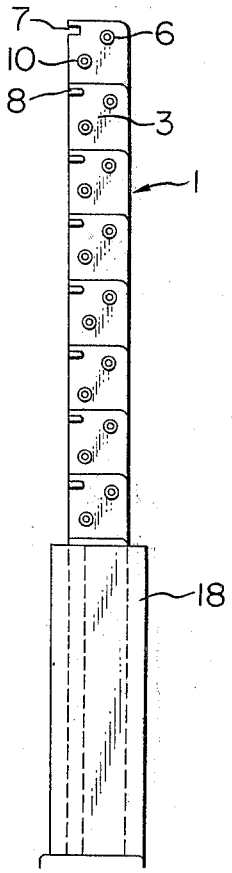
FIG. 12 is a partial front view of a continuous series of the unit block members of FIG. 11.
Figure 13:
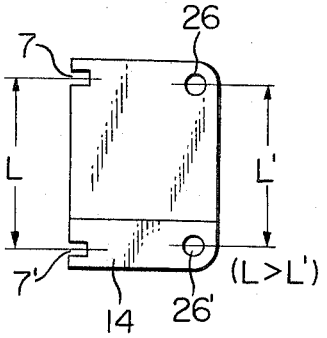
FIG. 13 is a side view of another unit block member employed in accordance with the invention.
Figure 15:
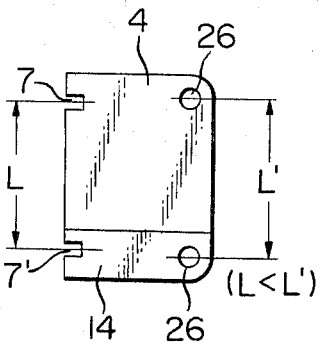
FIG. 15 is a side view of still another unit block member employed in accordance with the invention.

As is apparent from the above, the connecting plate 5 of the unit block member 3 of the articular pole 1 has such a function that, when the pole 1 is pulled out from the spiral take-up casing 2 and the bent projections 8 and 8 of the connecting plate 5 are engaged with the guide grooves 17 and 17, respectively, then the projections 8 and 8 are engaged with the notches 7 and 7' of the side plates 4 and 4' of the adjacent unit block member under the resilient action of the spring 9. The engaging of the projections 8 and 8 with the notches 7 and 7' is promoted with a guide roller 24, which is disposed on the spiral take-up casing 2 for guiding the unit block members 3. Although FIGS. 1 to 3 and 5 to 8 show the spiral take-up casing 2 having a rectangular cross-section with one open side, it is also possible to employ another take-up casing which has, for instance, a closed cross-section without any open sides as shown in FIGS. 9 and 10.

Furthermore, the shape of the take-up casing is not limited only to a spiral shape. The take-up casing may also have an arched shape, an L-shape or the like.

As shown in FIGS. 11 to 16, if the distance L between the notches 7 and 7' of the side plates 4 and 4' is equal to the distance L' between the openings 26 and 26' for the pin 6 ($L=1''$), then the pole 1 forms a straight line when it has been pulled out from the casing 2. If $L>L'$, the pole 1 forms an arch turning to the right. If $L<L'$, the pole 1 forms an arch turning to the left.

Figure 14:
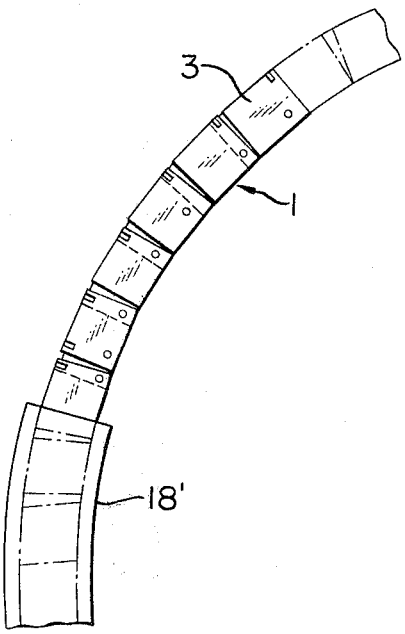
FIG. 14 is a partial front view of a continuous series of the unit block members of FIG. 13.
Figure 16:
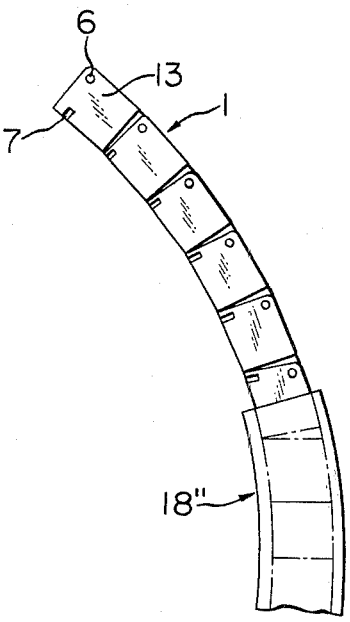
FIG. 16 shows a partial front view of a continuous series of the unit block members of FIG. 15.
Figure 17:
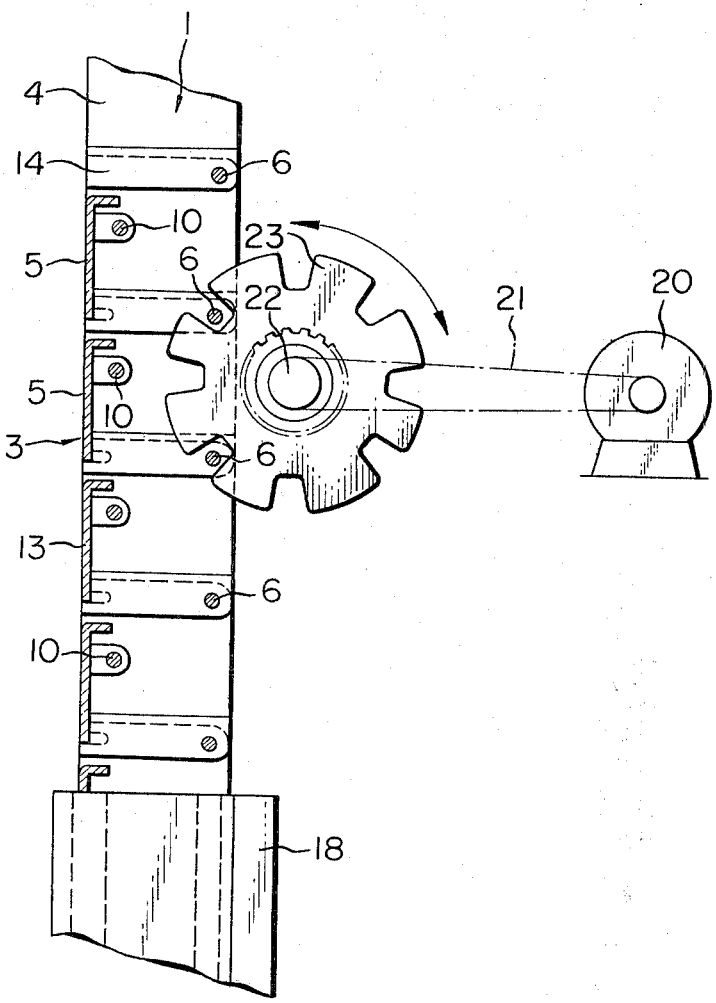
FIG. 17 is a partial longitudinal sectional view of an articular pole driven by a motor according to the invention.

As shown above, it is possible to vary the form of the pole 1 depending on the purpose for which it is used. Although FIGS. 14 and 16 shows the grooves 18' and 18'', having a curved shape, respectively, these grooves may have another shape such a linear one, because these grooves serve as a mere guide for the movement of the pole means 1, and the pole 1 may be curved at a portion behind these grooves in the take-up casing 2.

It will be seen from the above that the present articular pole assembly is strong and durable. When the articular pole 1 is in the extended state, it has a satisfactory load bearing capacity for the following reasons: the continuous series of the unit block members 3 are tightly connected to one another by the pins 6; the projections 8 and 8 of each unit block member 3 are engaged with the notches 7 and 7' of the adjacent unit block member, respectively, with the aid of the springs 9; and, when the articular pole 1 has been loaded, the stepped portions 14 and 14 of each unit block member 3 abut on the front ends of the side plates 4 and 4' of the adjacent unit block member, respectively, so that the pole 1 can be surely kept from any undesirable sagging.

Figure 19:
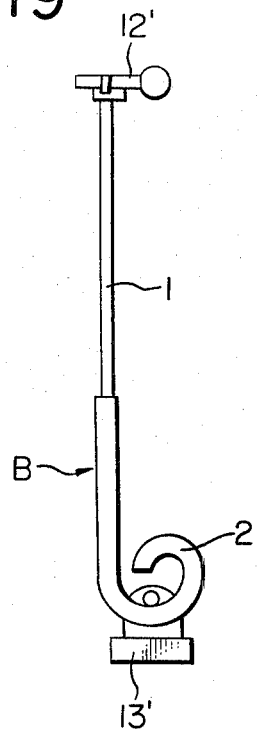
FIG. 19 is a side view of a microphone supported on an articular pole assembly according to the invention.
Figure 18:
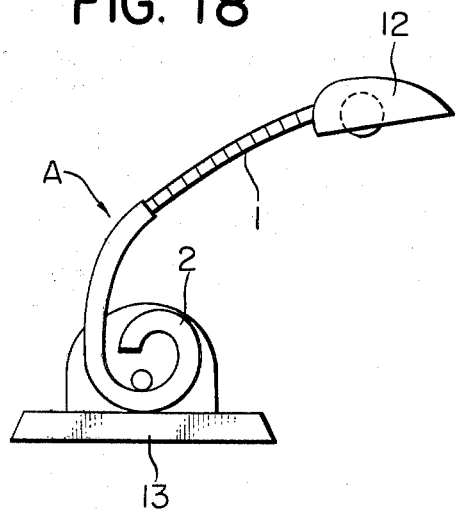
FIG. 18 is a side view of a desk lamp employing an articular pole assembly according to the invention.
Figure 20:
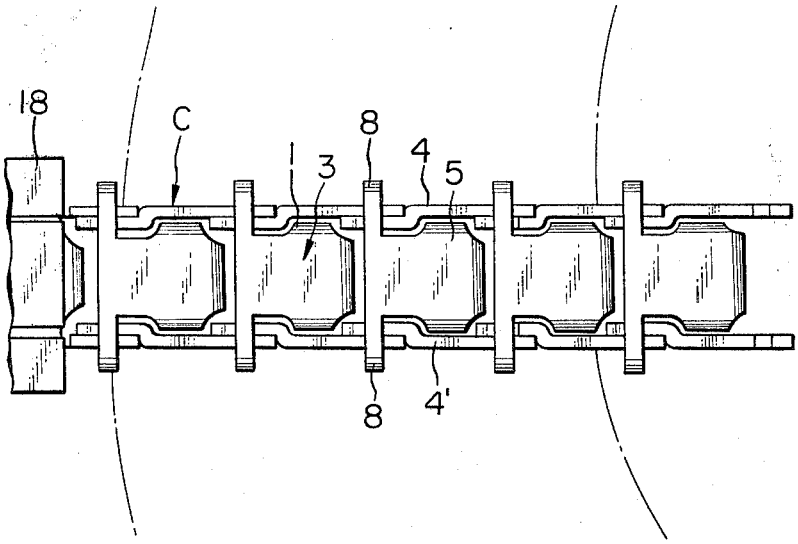
FIG. 20 is a front view of a bridge employing an articular pole assembly according to the invention.

FIG. 18 shows desk lamp A comprising an electric-light bulb 12 supported on an articular pole assembly 13 according to the invention. FIG. 19 shows a microphone stand B comprising a microphone 12' supported on an articular pole assembly 13' according to the invention. FIG. 20 shows an emergency bridge C consisting of an articular pole assembly according to the invention.

The present articular pole assembly has a simple and strong structure and can be fabricated by connecting a continuous series of unit block members together. The pole length can be adjusted at will. The pole can be stored in a wound or curved state in a take-up casing, so that the casing can be placed even in a relatively small space.

I claim:

1. An articular pole assembly comprising:

an articular pole which is composed of a continuous series of unit block members connected to one another, the unit block members each having a pair of side plates and a connecting plate pivotally mounted therebetween, the side plates being connected to the corresponding side plates of the adjacent unit block member by a pin, the connecting plate having bent projections releaseably engaged with notches in said side plates and in the side plates of the adjacent unit block member and a spring urging the bent projections of the connecting plate to push towards the notches of the side plates; and a take-up casing having a desired shape for the take-up of the pole in a curved state, the take-up casing having cam portions co-acting with said bent portions for disengaging the bent projections from the notches against the resilient action of the spring so as to make the unit block member rotatable about the pins, whereby the unit block members can be accommodated in a curved state in the casing.

2. An articular pole assembly as claimed in claim 1, wherein the distance between the notches of the side plates is equal to that between the openings of the side plates for the pin, so that the articular pole has a form of a straight line when it is in the extended state.

3. An articular pole assembly as claimed in claim 1, wherein the articular pole is moved by hand.

4. An articular pole assembly as claimed in claim 1, wherein the take-up casing has a circular form.

5. An articular pole assembly as claimed in claim 1, wherein the take-up casing has a spiral form.

6. An articular pole assembly as claimed in claim 1, wherein the take-up casing has a rectangular cross section.

7. An articular pole assembly as claimed in claim 1, wherein the distance between the notches of the side plates is unequal to that between the openings of the side plates for the pin, so that the articular pole has a form of a curved line, when it is in the extended state.

8. An articular pole assembly as claimed in claim 1, wherein the articular pole is moved by a motor via a transmission member.

9. An articular pole assembly as claimed in claim 1, wherein each side plate has a stepped portion along one edge thereof adjacent the next unit block, the stepped portions of the side plates of one unit block being nested inside of the side plates of the next unit block when the articular pole is in the extended state, said pin extending through the side plates of the next unit block and the stepped portions of the side plates of said one unit block.

10. An articular pole assembly as claimed in claim 6, wherein each said pin has ends extending from opposite sides of said side plates and said take-up casing has grooves therein accommodating said ends of said pins and guiding said unit blocks.

11. An articular pole assembly comprising:

an articular pole which is composed of a continuous series of unit blocks pivotally connected together, the unit blocks each having a pair of side plates and a connecting plate pivotally mounted therebetween, the side plates being connected to the corresponding side plates of the adjacent block member by a pin and having two pairs of notches therein, one notch of each pair being in one side plate, the connecting plate having bent projections and being moveable between an unengaged position and an engaged position where said bent projections engage both one pair of notches in the side plates of the unit block and one pair of notches in the side plates of the adjacent unit block to the adjacent unit block; and a take-up casing having means contacting said connecting plate for moving said connecting plate from the engaged position to the unengaged position and means for compactly storing said plurality of unit blocks.

* * * * *